US010342252B2

(12) United States Patent
Sikora et al.

(10) Patent No.: US 10,342,252 B2
(45) Date of Patent: Jul. 9, 2019

(54) APPARATUS FOR CENTRING OF A ROD-LIKE ARTICLE OR A ROD-LIKE ARTICLE GROUP

(71) Applicant: PHILIP MORRIS PRODUCTS S.A., Neuchatel (CH)

(72) Inventors: Leszek Sikora, Radom (PL); Radoslaw Owczarek, Radom (PL)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/558,252

(22) PCT Filed: Apr. 15, 2016

(86) PCT No.: PCT/IB2016/052167

§ 371 (c)(1),
(2) Date: Sep. 14, 2017

(87) PCT Pub. No.: WO2016/170457

PCT Pub. Date: Oct. 27, 2016

(65) Prior Publication Data

US 2018/0098566 A1 Apr. 12, 2018

(30) Foreign Application Priority Data

Apr. 21, 2015 (PL) ..... 412017

(51) Int. Cl.
*A24C 5/00* (2006.01)
*A24C 5/47* (2006.01)
*A24C 5/32* (2006.01)

(52) U.S. Cl.
CPC ..... *A24C 5/478* (2013.01); *A24C 5/327* (2013.01)

(58) Field of Classification Search
CPC ..... A24C 5/327; A24C 5/478
(Continued)

(56) References Cited

U.S. PATENT DOCUMENTS 2,821,201 A 1/1958 Brunswig
3,094,128 A 6/1963 Dearsley
(Continued)

FOREIGN PATENT DOCUMENTS

DE 954038 12/1956
DE 1008173 5/1957
(Continued)

OTHER PUBLICATIONS

PCT Search Report and Written Opinion for PCT/IB2016/052167 dated Jul. 13, 2016 (7 pages).

*Primary Examiner* — Douglas A Hess
(74) *Attorney, Agent, or Firm* — Mueting, Raasch & Gebhardt, P.A.

(57) ABSTRACT

Apparatus (1, 1') for axial centring of a rod-like article (4, 4') or a group (30) of rod-like articles wherein the rod-like article (4, 4') or the group (30) of rod-like articles is conveyed in a flute (3) situated on the circumference of a drum conveyor (2), whereas the length of the article (4, 4') or the total length of articles in the group (30) may vary, provided with pusher elements (5) acting on the rod-like article (4, 4') or the group (30) of rod-like articles, characterized in that the pusher elements (5) of a shifting mechanism (13) are driven by a common driving unit (24, 24') and are connected in such a way that the force exerted by the driving unit (24, 24') is distributed to the pusher elements (5) acting axially on the rod-like article (4, 4') or the group (30) of rod-like articles. The object of the application is also a method of axial centring of the rod-like article (4) or the group (30) of rod-like articles wherein the rod-like article (4, 4') or the group (30) of rod-like articles is conveyed in the flute (3) situated on the circumference of the drum conveyor (2), by means of the pusher elements (5), whereas the length of the article (4, 4') or the total length of articles in the group (30) may vary, characterized in that the force exerted by the
(Continued)

driving unit (24) is distributed to the pusher elements (5) of the shifting mechanism (13) acting axially on the rod-like article (4, 4') or the group (30) of rod-like articles.

14 Claims, 5 Drawing Sheets

(58) Field of Classification Search
USPC ..... 198/458, 473.1, 474.1, 478.1
See application file for complete search history.

(56) References Cited

U.S. PATENT DOCUMENTS 3,343,676 A 9/1967 Tyrrell
RE26,357 E * 3/1968 Griner et al. ..... A21C 15/00 198/418
3,866,737 A * 2/1975 Simon ..... B65B 35/405 198/470.1
4,483,351 A * 11/1984 Seragnoli ..... A24C 5/336 131/282
4,605,014 A 8/1986 Wahle
4,676,360 A * 6/1987 Mattei ..... A24C 5/336 198/377.1
5,135,008 A * 8/1992 Oesterling ..... A24C 5/471 131/84.4
6,328,832 B1 * 12/2001 Otruba ..... B65C 9/1807 156/215
6,425,400 B1 7/2002 Krause
6,450,230 B1 * 9/2002 Otruba ..... B65C 9/1807 156/542
6,471,036 B1 * 10/2002 Schlisio ..... A24C 5/336 198/377.01
8,820,513 B2 * 9/2014 Papsdorf ..... A61F 13/15764 198/478.1
9,511,951 B1 * 12/2016 Schneider ..... B65G 47/848

FOREIGN PATENT DOCUMENTS

EP 0577061 3/1996
EP 1033083 5/2003
EP 1913822 11/2011
GB 767275 1/1957

* cited by examiner

APPARATUS FOR CENTRING OF A ROD-LIKE ARTICLE OR A ROD-LIKE ARTICLE GROUP

This application is a U.S. National Stage Application of International Application No. PCT/IB2016/052167, filed Apr. 15, 2016, which was published in English on Oct. 27, 2016, as International Publication No. WO 2016/170457 A1. International Application No. PCT/IB2016/052167 claims priority to Polish Application No. 412017 filed Apr. 21, 2015.

The object of the invention is an apparatus for centring of a rod-like article or a rod-like article group.

Drum conveyors for conveying rod-like articles, provided on the circumference with multiple flutes situated parallel to the axis of rotation of the conveyors, are commonly used in the tobacco industry. Rod-like articles are understood as filter rods manufactured of a single kind of filter material, any rod-like products and semi-finished products of the tobacco industry comprising multi-segment filter rods containing filter segments, multi-segment filter rods containing filter segments and additional components altering or giving the articles' aroma, multi-segment filter rods containing filter segments and additional objects varying the filter properties of filter materials used, multi-segment rods containing both filter and non-filter segments, multi-segment articles with reduced tobacco content, cigarettes without a mouth piece and cigarettes with a single-segment or multi-segment mouth piece stuck on. During the conveying in the flutes of the drum, rod-like articles are held in the flutes by means of negative pressure supplied by means of holes made in the flutes, whereas it is possible to convey one or multiple rod-like articles in one flute. Due to the production process it is necessary during the rotational movement of drum conveyors to shift rod-like articles axially that is along the flutes of drum conveyors so as to obtain repeatable positions of individual articles relative to front surfaces of the drum itself and of other units of the machine. The articles are shifted among others to achieve repeatable positions of rod-like articles relative to the plane of a rotary knife or multiple rotary knives provided for cutting rod-like articles. The cutting of conveyed articles in the form of filter-rods or article groups in the form of filter and tobacco rods joined by means of the wrapping material takes place on machines for the manufacture and joining of filter and tobacco portions of cigarettes.

In the tobacco industry, devices for the shifting of rod-like articles in the flutes of drum conveyors are known from the prior art. For example, a device for the centring of groups of rod-like articles is known from publication DE1008173, whereas such article group consists of one filter portion and two tobacco portions. Each of the portions is made with a certain length tolerance so that each group may have a slightly different total length being a sum of lengths of individual articles. The device is provided with two centring rings and is designed for correct centring of a group with a maximum total length, other groups will not be centred which will be apparent in the difference in length of two portions which will be formed by cutting conveyed groups once they have been wrapped in a tipping paper joining the filter and tobacco portions. Another device for the centring of the same article groups is disclosed in the document GB 767,275. Differences in the length of individual articles lead to the centring of article groups with a certain deviation except for groups with the maximum total length. The U.S. Pat. No. 3,343,676 describes a device for the shifting of article groups by means of single pushers where the article groups are positioned relative to the plane at one of the ends of article groups. Opposite ends of article groups will be positioned depending on the total length of the article group. In each of the devices described above it is not possible to cut all article groups into two parts with the same length.

The objective of this invention is to develop an apparatus for the crosswise conveyance of rod-like articles of the tobacco industry which would allow centring of all conveyed articles irrespective of their length, i.e. such positioning of articles that their centres would be situated in one plane.

The object of the invention is an apparatus for axial centring of a rod-like article or a group of rod-like articles wherein the rod-like article or the group of rod-like articles is conveyed in the flute situated on the circumference of the drum conveyor, and the length of the article or the total length of articles in a group in the flute of the drum conveyor may vary, in addition, the apparatus is provided with pusher elements of a shifting mechanism acting on the rod-like article or the group of rod-like articles so as to change their position in the flute. The apparatus is characterised in that the pusher elements of the shifting mechanism are driven by a common driving unit, and are shaped and/or connected in such a way that the force exerted by the driving unit is distributed to the pusher elements acting axially on the rod-like article or the group of rod-like articles so that the centres of the rod-like article or the group of rod-like articles are positioned principally in a single plane.

Furthermore, the apparatus according to the invention is characterised in that the force exerted by the driving unit is divided into two equal partial forces acting on the rod-like article or the group of rod-like articles.

Furthermore, the apparatus according to the invention is characterised in that the force exerted by the driving unit is transferred to the pusher elements through a cushioning unit.

The apparatus according to the invention is characterised in that the cushioning unit is provided with at least one resilient element.

The apparatus according to the invention is characterised in that the cushioning unit is provided with at least one spring.

The apparatus according to the invention is characterised in that the pusher elements are attached to brackets connected with a lever driven by the driving unit.

The apparatus according to the invention is characterised in that the pusher elements take a symmetric position to the symmetry plane of the drum conveyor.

The apparatus according to the invention is characterised in that the shifting mechanism is driven by a cam.

The apparatus according to the invention is characterised in that the shifting mechanism is driven by a pneumatic element.

Furthermore, the substance of the invention is a method of axial centring of a rod-like article or a group of rod-like articles wherein the rod-like article or the group of rod-like articles is conveyed in the flute on the circumference of a drum conveyor by means of pusher elements, whereas the article length or the total length of articles in the group may vary. The method is characterised in that the force exerted by a driving unit is distributed to the shifting mechanism's pusher elements acting axially on the rod-like article or the group of rod-like articles so that the centres of the rod-like articles or the groups of rod-like articles are positioned principally in a single plane.

The method according to the invention is characterised in that the force exerted by at least one driving unit is divided into two equal partial forces acting on rod-like articles or groups of rod-like articles.

An advantage of the invention is that the apparatus acts individually on conveyed individual rod-like articles as delicately as possible and does not cause any damage to the ends of articles irrespective of the length of individual articles.

For the purpose of better understanding, the object of the invention has been illustrated in embodiments in a drawing in which.

Figure 1:
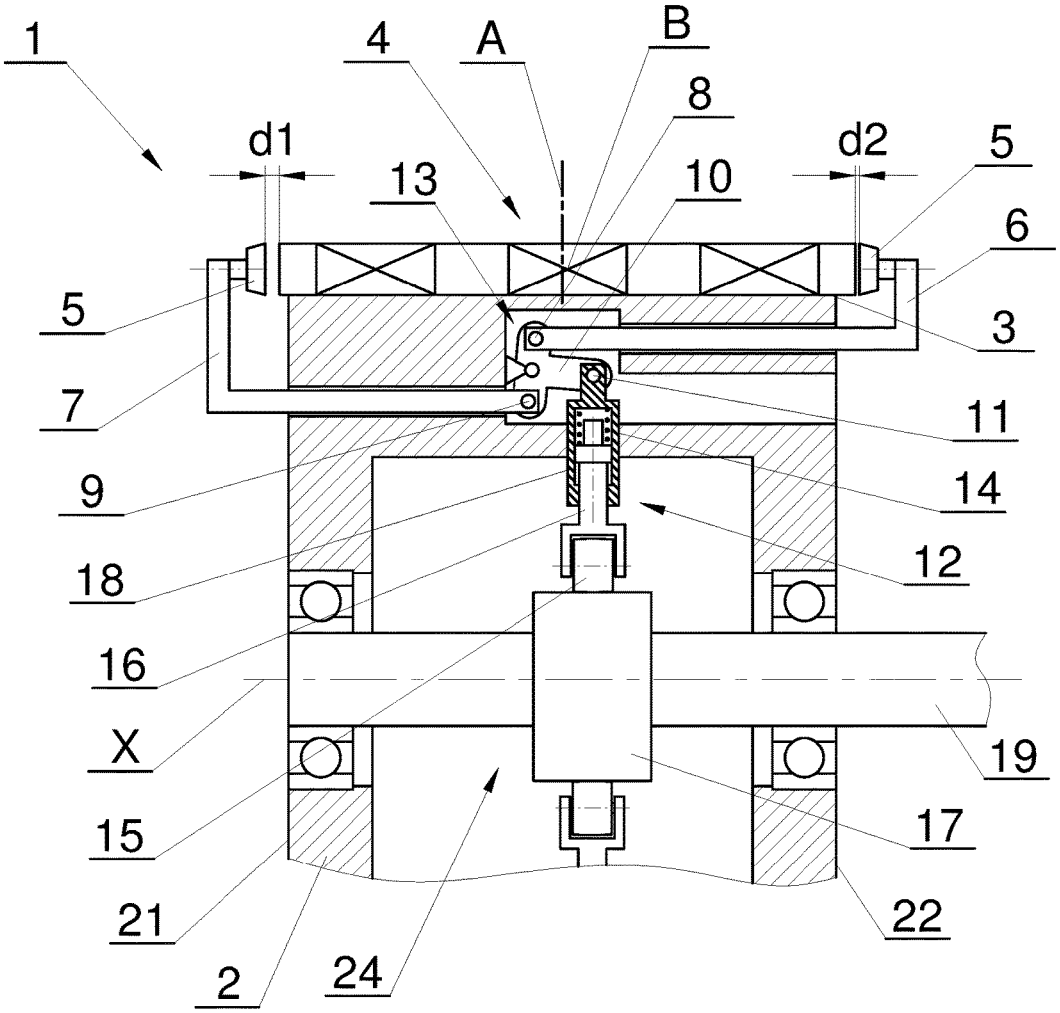
FIG. 1 shows an apparatus according to the invention in a first embodiment where the pusher elements are pushed away from the rod-like article.
Figure 6:
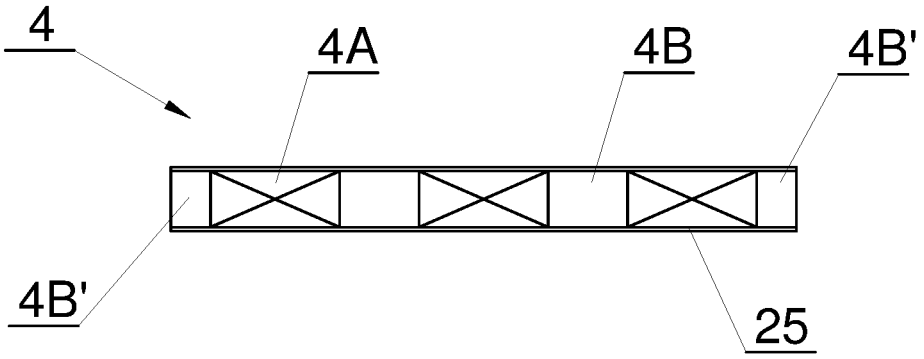
FIG. 6 shows an example of a rod-like article.
Figure 7:
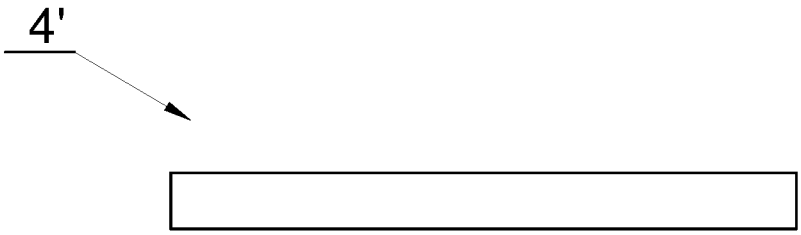
FIG. 7 shows another example of a rod-like article.

The drum conveyor 1 shown in FIG. 1, comprising a drum 2 adapted to rotate around an axis of rotation X, the drum 2 having multiple flutes 3 on the circumference for the conveying of rod-like articles 4 crosswise to the axis of the articles 4, with the flutes 3 being situated parallel to the axis of rotation X of the drum 2. FIG. 1 shows a rod-like article 4 in the form of a multi-segment rod, in other words it is a group of rod-like articles joined with a common wrapping material. The multi-segment rod 4, shown also in FIG. 6, is built of alternately situated rod-like articles 4A, 4B and 4B' (a half of the article 4B) and is wrapped with the common wrapping material 25. The apparatus according to the invention may also be used for a group of several rod-like articles not wrapped with a common wrapping material (FIG. 3), for example for a group 30 comprising a tobacco rod 31, a filter rod 32 and a tobacco rod 31, whereas from such a group two cigarettes will be manufactured after previous wrapping of the filter rod 32 and the ends of tobacco rods 31 with a paper wrapper. The apparatus shown may also be used for individual filter rods 4' made of a single kind of material (FIG. 7). Rod-like articles are usually held in the flutes by means of negative pressure supplied through holes situated along the flutes 3 (the negative pressure holes have not been shown). At the ends of each flute 3 there are pusher elements 5 attached to brackets respectively 6 and 7, of the shifting mechanism 13. The brackets 6 and 7 are connected by the joints 8 and 9 and the lever 10 self-aligning relative to the drum 2. The lever 10 is connected by the joint 11 with a cushioning unit 12 having a body 18, a spring 14 and a roller 15 attached to a rod 16 and mating with a cam 17 on a stationary shaft 19.

FIG. 1 shows the plane A perpendicular to the axis X which in a particular case may be the symmetry plane of the drum 2, i.e. the symmetry plane for the front surfaces 21 and 22. The plane A may overlap the plane of a not shown rotary knife used to cut the article 4 into two parts, whereas the cutting of the drum usually takes place on another drum. The shown example of the rod-like article 4 has its geometric centre at the point marked as B, as can be seen it does not lie in the plane A. The pusher elements 5 are situated symmetrically to the plane A. The distances of ends of the rod-like article 4 from the pusher elements 5 have been described by the dimensions d1 and d2, whereas in view of the asymmetric position of the article 4 the dimension d1 is greater than d2.

Figure 2:
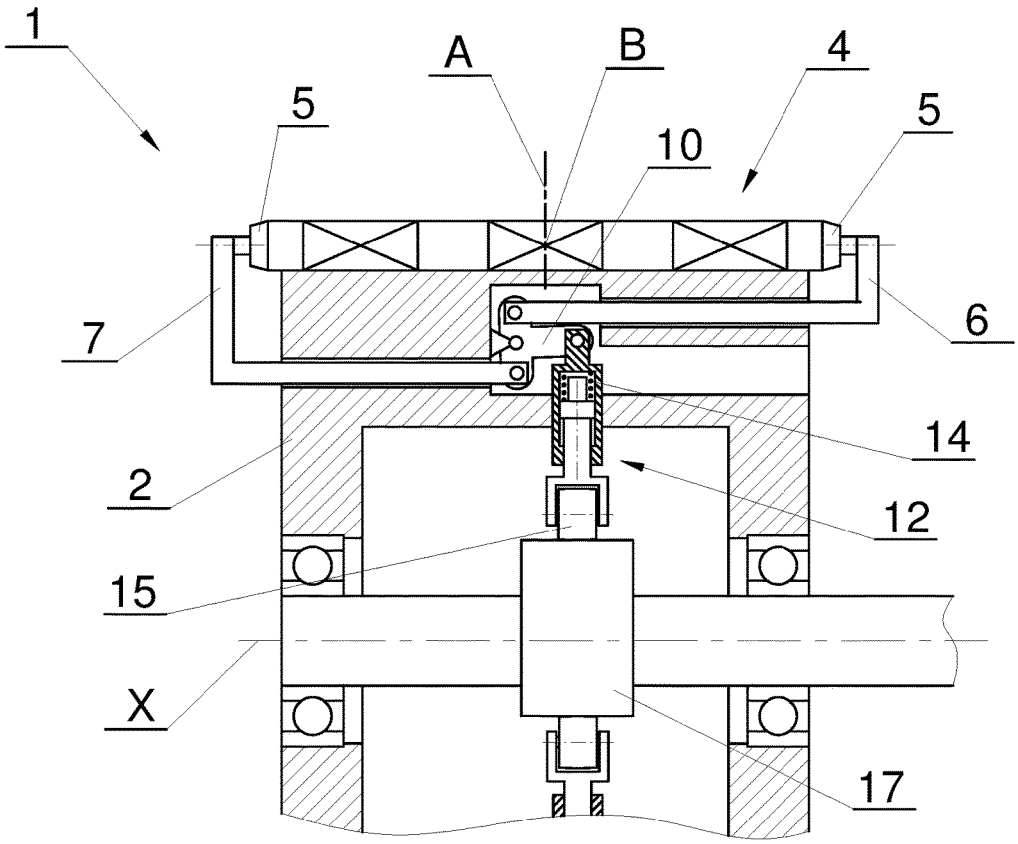
FIG. 2 shows an apparatus according to the invention in the first embodiment where the pusher elements are pushed close to the rod-like article.

The position of elements of the apparatus 1 for the centring of rod-like articles 4, including the position of the shifting mechanism 13, shown in FIG. 1 relates to a situation where the article 4 has been placed in the flute 3 of the drum 2 and has not yet been shifted so that its centre B would be in the symmetry plane A of the drum 2. During the rotation of the drum 2 the roller 15 by rolling on the cam 17 and moving angularly to the cam 17 will be radially shifted in the direction from the axis X to the flutes 3, which will cause a shift of the cushioning unit 12 as shown in FIG. 2. The movement of the cushioning unit 12 is transferred to a rotational movement of the lever 10 which, in turn, will be transferred to the movement of the brackets 6 and 7 and the pusher elements 5 attached to the brackets 6 and 7. Due to the use of the cushioning unit 12, the article 4 is delicately moved in such a way that its centre B is situated in the fixed plane A. It takes place because the pusher elements 5 approach the plane A at a uniform rate, and the force exerted by the driving unit 24 transferred to the pusher elements 5 is separated into two equal parts, and irrespective of the original position of the article 4 it will be placed in the fixed central position. Having pushed the pusher elements 5 close to the ends of the article 4 and having fixed the position of the article 4 relative to the plane A the cushioning unit 12 moves further radially to the axis X, whereas the spring 14 is compressed because the pusher elements 5 do not move. It is possible to use any resilient material. The force applied by the spring 14 to the ends of the article 4 is selected in such a way as to avoid damaging the ends of the article 4. Each successive rod-like article 4 conveyed in the successive flute 3 is centred in a repeatable manner relative to the fixed plane A by means of the pusher elements 5 situated at that flute and driven by means of a separate roller 15. The shifting mechanism 13 puts the articles 4 in a fixed position being symmetric to the pusher elements 5 regardless of their actual length resulting from the length tolerance determined during the production of the articles 4. The centring movement stroke of the pusher elements 5 is selected in such a way that it encompasses the position of the pusher elements 5 for both maximum and minimum length of the rod-like article, whereas the rod-like articles 4 always take a symmetric position relative to the plane A.

Figure 3:
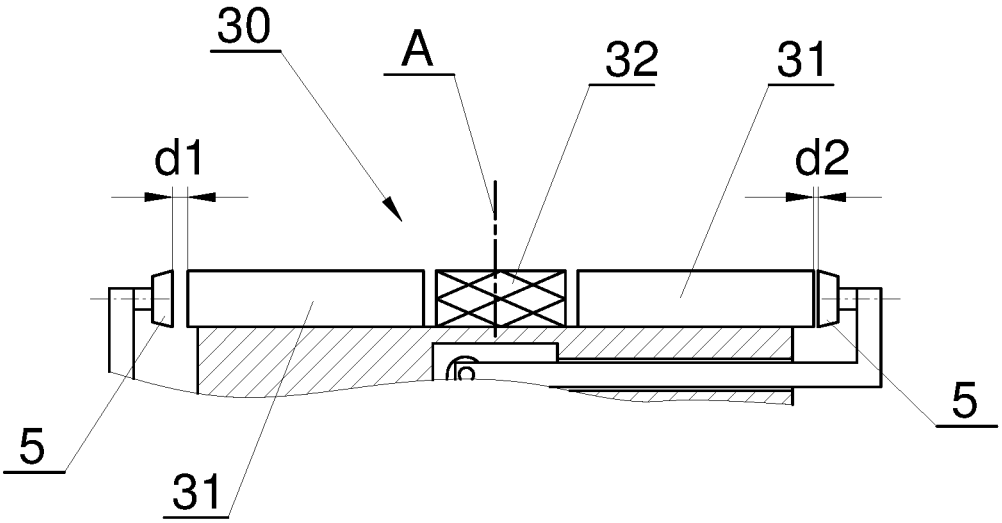
FIG. 3 shows a fragment of the apparatus of FIG. 1 for a group of rod-like articles.
Figure 4:
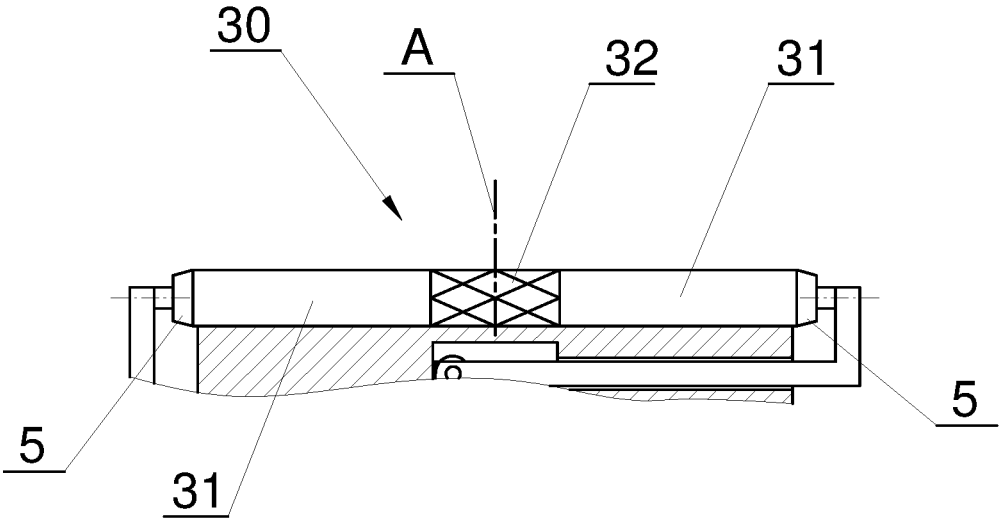
FIG. 4 shows a fragment of the apparatus of FIG. 2 for a group of rod-like articles.

FIGS. 3 and 4 show the operation of the shifting mechanism 13 for a group 30 comprising three rod-like articles, namely two tobacco rods 31 and one filter rod 32. During the rotation of the drum 2 the pusher elements 5 will move in the direction of the ends of the rods 31, after pushing the tobacco rods 31 to abut the filter rod 32 the group 30 will be centred in such a way that the geometric centre of the group will be situated in the fixed plane A (FIG. 4).

Figure 5:
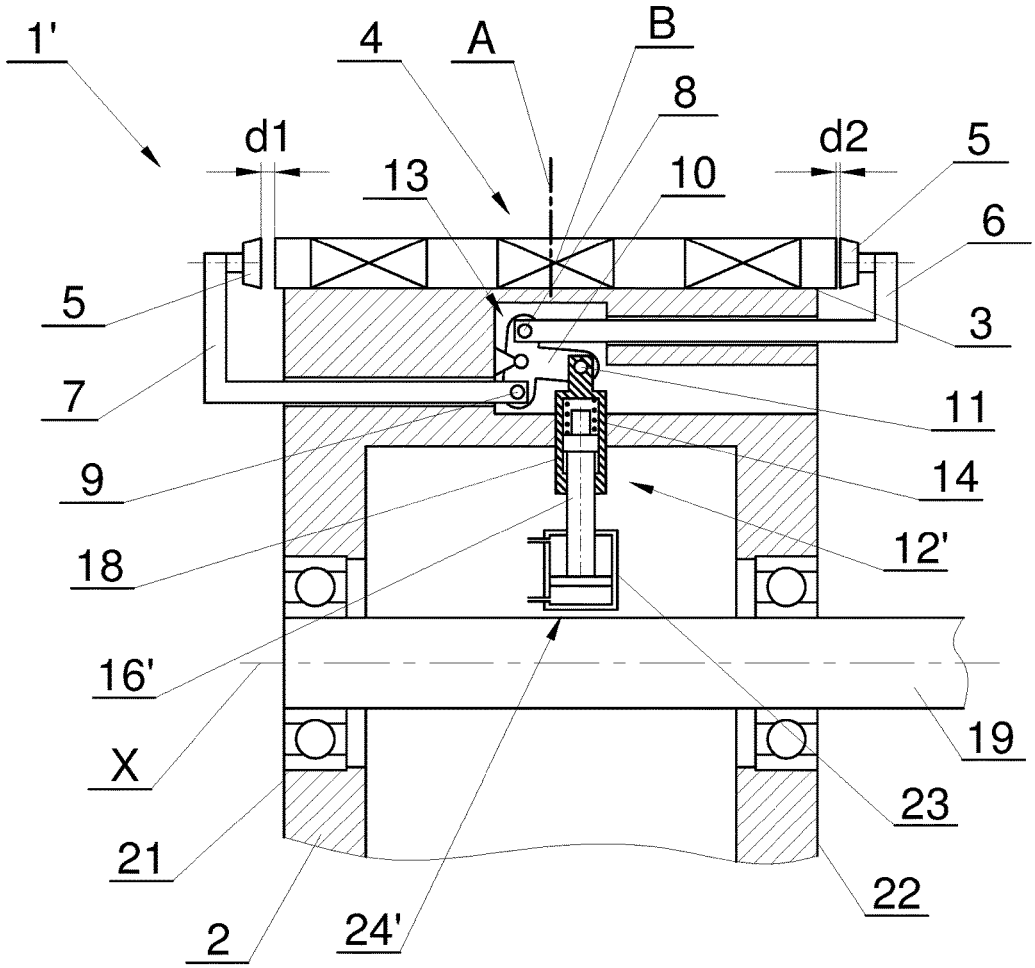
FIG. 5 shows an apparatus according to the invention in a second embodiment where the pusher elements are pushed away from the rod-like article.

The conveying apparatus 1' in the second embodiment shown in FIG. 5 is designed similar to the apparatus in the first embodiment. A pneumatic actuator 23 was used to drive the shifting mechanism 13. The piston of the pneumatic actuator 23 is connected with the rod 16' of the cushioning mechanism 12'. The pneumatic actuator may be a double or single acting actuator.

The invention claimed is:

1. An apparatus for axial centring of a rod-like article or a group of rod-like articles, wherein the rod-like article or the group of rod-like articles is conveyed in a flute situated on the circumference of a drum conveyor, and the length of the article or the total length of articles in the group in the flute of the drum conveyor may vary, wherein the apparatus is provided with pusher elements of a shifting mechanism acting on the rod-like article or the group of rod-like articles so as to change their position in the flute, wherein the pusher elements of the shifting mechanism are driven by a common driving unit comprising a cam or a pneumatic element, and wherein the pusher elements are shaped or connected to the common driving unit in such a way that a force exerted by the driving unit is distributed to the pusher elements acting axially on the rod-like article or the group of rod-like articles so that the centres of the rod-like articles or the groups of rod-like articles are positioned principally in a single plane extending perpendicular to the axis of rotation of the drum conveyor.

2. The apparatus of claim 1, wherein the force exerted by the common driving unit is divided into two equal partial forces acting on the rod-like article or the group of rod-like articles.

3. The apparatus of claim 1, wherein the force exerted by the common driving unit is transferred to the pusher elements through a cushioning unit.

4. The apparatus of claim 3, wherein the cushioning unit is provided with at least one resilient element.

5. The apparatus of claim 4, wherein the cushioning unit is provided with at least one spring.

6. The apparatus of claim 1, wherein the pusher elements are attached to brackets connected with a lever driven by the common driving unit.

7. The apparatus of claim 6, wherein the pusher elements take a symmetric position relative to the single plane extending perpendicular to the axis of rotation of the drum conveyor.

8. The apparatus of claim 1, wherein the shifting mechanism is driven by the cam.

9. The apparatus of claim 1, wherein the shifting mechanism is driven by the pneumatic element.

10. A method of axial centring of a rod-like article or a group of rod-like articles, wherein the rod-like article or the group of rod-like articles is conveyed in a flute situated on the circumference of a drum conveyor having an axis of rotation by pusher elements of a shifting mechanism, and the length of the article or the total length of articles in the group may vary, and wherein a force exerted by a common driving unit is distributed to the pusher elements of the shifting mechanism, the common driving unit comprising a cam or a pneumatic element acting axially on the rod-like article or the group of rod-like articles so that the centres of the rod-like articles or the groups of rod-like articles are positioned principally in a single plane extending perpendicular to the axis of rotation of the drum conveyor.

11. The method of claim 10, wherein the force exerted by the common driving unit is divided into two equal partial forces acting on the rod-like articles or the groups of rod-like articles.

12. The method of claim 10, wherein the force exerted by the common driving unit is transferred to the pusher elements through a cushioning unit.

13. The method of claim 10, wherein the shifting mechanism is driven by the cam.

14. The method of claim 10, wherein the shifting mechanism is driven by the pneumatic element.

* * * * *